US005131124A

United States Patent [19]

Skotek

[11] Patent Number: 5,131,124

[45] Date of Patent: Jul. 21, 1992

[54] STRIP FEEDER FOR TERMINAL APPLICATION

[75] Inventor: David A. Skotek, Harrisburg, Pa.

[73] Assignee: AMP Incorporated, Harrisburg, Pa.

[21] Appl. No.: 722,641

[22] Filed: Jun. 27, 1991

[51] Int. Cl.[5] ..... H01R 43/055

[52] U.S. Cl. ..... 29/33 M; 29/748

[58] Field of Search ..... 29/33 M, 33 K, 33 Q, 29/33 S, 564.1, 564.2, 705, 715, 741, 748, 749, 771, 786, 788, 793, 796; 72/404, 442, 446

[56] References Cited

U.S. PATENT DOCUMENTS

| | | | |
|---|---|---|---|
| 3,184,950 | 5/1965 | Sitz . | |
| 3,343,398 | 9/1967 | Kerns . | |
| 3,496,626 | 2/1970 | Ullman et al. . | |
| 3,763,555 | 10/1973 | Van de Kerhof | 29/628 |
| 3,766,625 | 10/1973 | Wagner | 29/203 |
| 4,025,999 | 5/1977 | Wolyn et al. | 29/788 X |
| 4,114,253 | 9/1978 | Loomis et al. | 29/566.2 |
| 4,531,280 | 7/1985 | Bakermans | 29/33 M X |
| 4,718,160 | 1/1988 | Bulanda et al. | 29/566.2 |
| 5,033,187 | 7/1991 | Gloe et al. | 29/715 |

FOREIGN PATENT DOCUMENTS

| | | | |
|---|---|---|---|
| 0192102 | 8/1986 | European Pat. Off. | 29/749 |

*Primary Examiner*—Z. R. Bilinsky

[57] ABSTRACT

Strip feeding mechanism for a terminal applicator comprises a feed pawl which is mounted on an oscillatory pawl carrier so that oscillation of the pawl carrier results in to and from movement of the feed pawl. The pawl carrier is coupled by a torque responsive coupling to an oscillatory shaft which in turn is coupled through a gear train to a rack on the applicator ram. Reciprocation of the ram results in oscillation of the shaft which in turn results in oscillation of the pawl carrier. The amplitude of oscillation of the pawl carrier, and therefore the limits of the feed stroke of the feed pawl, are adjusted by means of a fixed stop which is on the applicator frame and movable stops which are on the pawl carrier. The torque responsive coupling permits overtravel of the shaft relative to the pawl carrier.

17 Claims, 4 Drawing Sheets

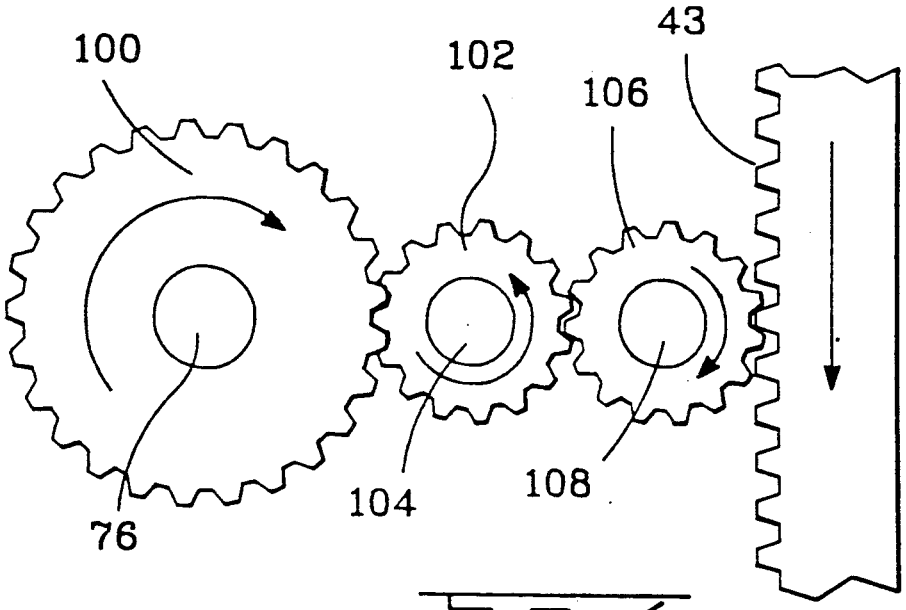
Fig. 4
Fig. 5
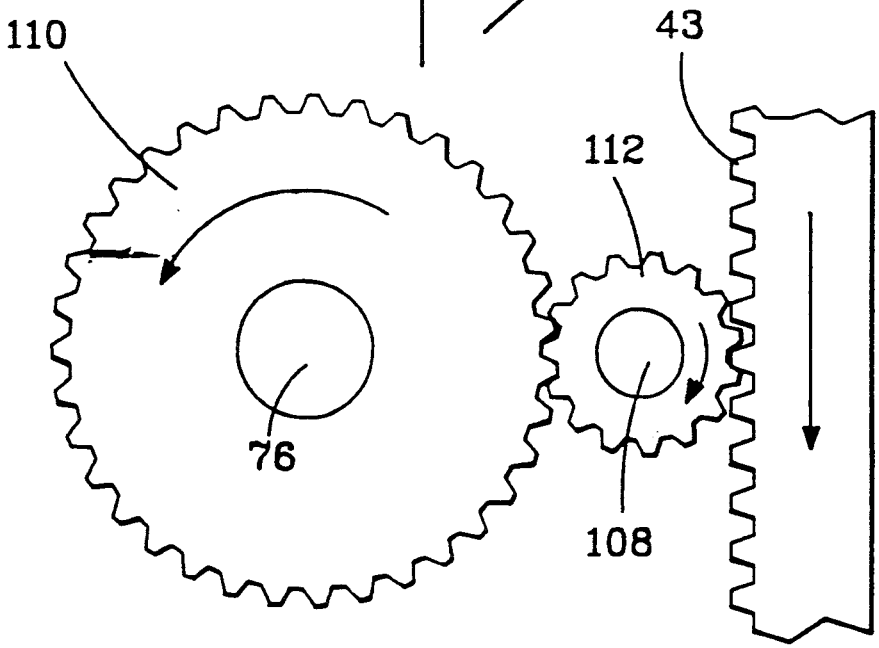

STRIP FEEDER FOR TERMINAL APPLICATION

FIELD OF THE INVENTION

This invention relates to strip feeding mechanisms for terminal applicators for crimping terminals onto the ends of wires.

BACKGROUND OF THE INVENTION

A conventional crimping machine comprises a press and a terminal applicator. The applicator is, in effect, a miniature press, having a press frame and a reciprocable ram in the frame which is coupled to the ram of the press. The applicator has a crimping zone in which the crimping tooling is mounted and has a self-contained feeding mechanism for feeding terminals in strip form to the crimping zone.

The feeding mechanism can be actuated by a pneumatic piston cylinder or, more commonly, by a camming mechanism on the applicator ram which reciprocates the feed pawl of the feeding mechanism. Mechanical feeding mechanisms which comprise a cam, cam follower, and a linkage to the feed pawl tend to be relatively complex and must be specifically designed for the terminal strip which will be used with the applicator.

The present invention is directed to the achievement of an improved strip feeder which is actuated by a rack on the applicator ram and a gear train which is between the applicator ram and the actual feeding mechanism.

THE INVENTION

The invention comprises a terminal applicator which in turn comprises a frame, a reciprocable ram, a crimping zone, and a feed pawl for feeding terminal strip towards the crimping zone. The applicator is characterized in that the feed pawl is pivotally mounted on an oscillatory pawl carrier which oscillates about an axis so that oscillation of the pawl carrier results in reciprocation of the feed pawl. An oscillatory shaft is provided which also oscillates about the common axis, and the shaft is coupled to the ram of the applicator by gear and rack means whereby reciprocation of the ram results in oscillation of the shaft. The shaft and the feed pawl carrier are coupled to each other by a torque responsive coupling which permits overtravel of the shaft relative to the pawl carrier if a predetermined torque is exceeded and which causes the pawl carrier to oscillate with the shaft when the predetermined torque is not exceeded. Stop means are provided for limiting the amplitude of oscillation of the pawl carrier and thereby limiting the stroke of the feed pawl.

In a preferred embodiment, the stop means comprises a fixed stop on the frame of the applicator and two movable stops on the pawl carrier. One of the movable stops limits movement of the pawl carrier towards the crimping zone and the other movable stop limits movement of the pawl carrier away from the crimping zone.

THE DRAWING FIGURES

FIGS. 4 and 5 are diagrammatic views of alternative gear trains for linking the applicator ram to the strip feeding mechanism.

THE DISCLOSED EMBODIMENT

Figure 1:
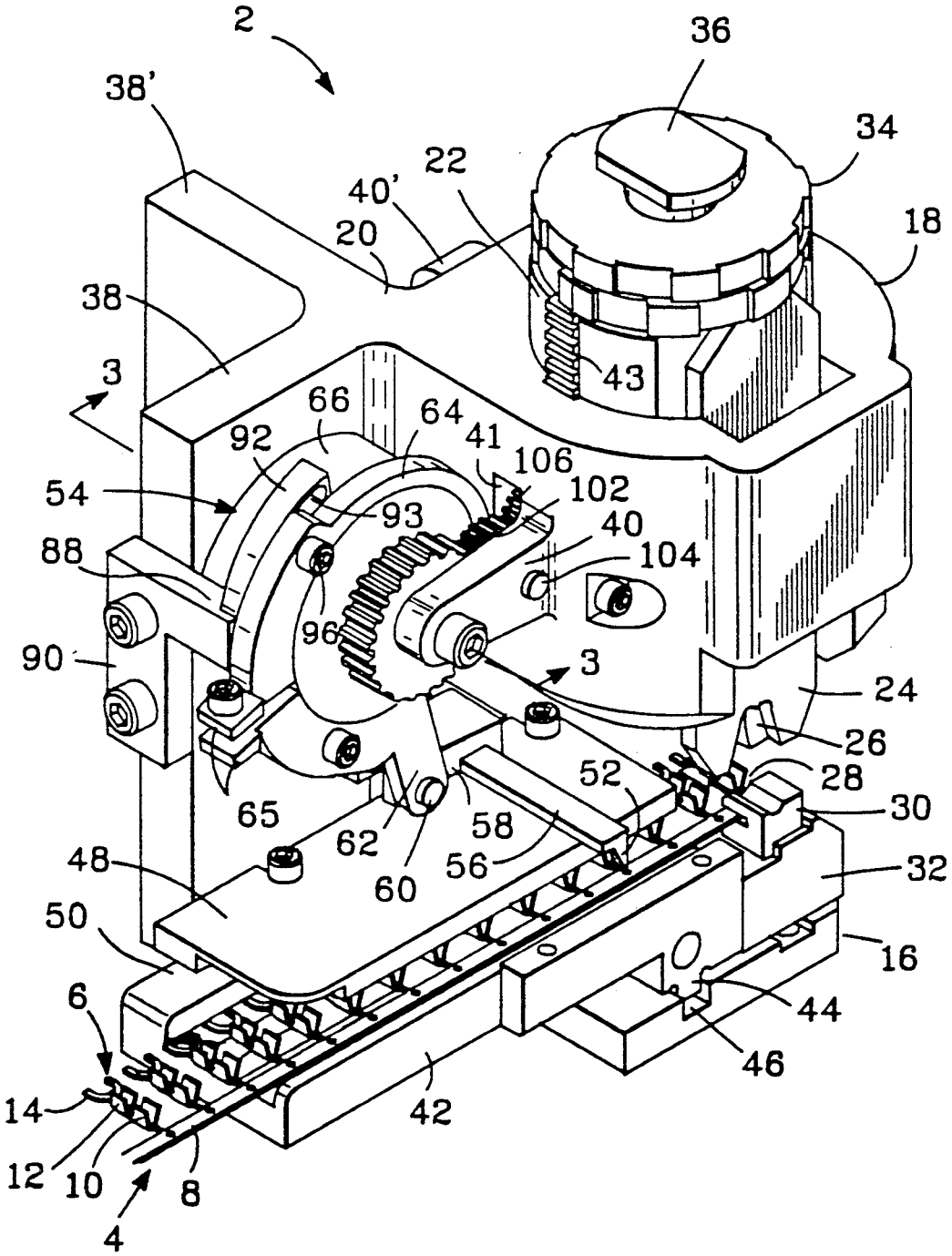
FIG. 1 is a perspective view of an applicator in accordance with the invention.

FIG. 1 shows an applicator 2 for crimping terminals onto the ends of wires. The terminals 6 are provided in the form of a continuous strip 4 with the terminals in side-by-side spaced apart relationship. The strip has a continuous carrier strip 8 and each terminal has crimp portions 10, 12, and a contact portion 14. The crimp portions 10 are crimped onto the insulation of the wire and are integral with the carrier strip 8.

The applicator 2 comprises a frame which in turn comprises a base 16, a ram housing 18, and a neck section 20 which extends between the ram housing and the base plate. The ram housing 18 has an opening, or passageway, extending therethrough which contains the reciprocable applicator ram 22. Crimping tooling 24, 26 is carried by the ram for cooperation with fixed crimping anvils 28 which are mounted on the base plate 16. When a terminal is crimped onto a wire, it is sheared from the carrier strip and it is desirable to sever the carrier strip at a location adjacent to the crimping zone. For this purpose, a movable shearing block 30 is provided which has a slot through which the carrier strip is fed. The movable shearing block 30 is resiliently mounted in a fixed shearing block 32, the arrangement being such that when the crimping operation is performed, the carrier strip is moved downwardly so that fixed and movable shearing edges move past each other and sever the strip at a location to the right of the fixed shearing block as viewed in FIG. 1.

The ram has dials 34 on its upper end for adjusting the positions of the crimping tools 24, 26 and has a coupling 36 by means of which the ram is coupled to the ram of the press in which the applicator is mounted. The base plate 16 is mounted on the platen of the press.

The connecting neck section of the press frame comprises arms 38, 38' which are integral with the housing and which are secured by fasteners (not shown) to the base plate. The ram housing has ears 40, 40' which extend outwardly at locations adjacent to, but spaced from, the arms 38, 38'. Openings 41 are provided in the ram housing adjacent to each of the ears 40, 40' and between the ear and the associated arm 38 or 38'.

As explained fully in commonly owned application Ser. No. 07/722,635 filed Jun. 27, 1991, now U.S. Pat. No. 5,127,255, applicator frame as shown can be used for either a side feed applicator for ladder strip as shown in the drawing or the frame can be used for an end feed applicator which is intended for use with terminals in in-line strip form; that is, with the trailing end of each terminal in the strip integral with the leading end of the next adjacent terminal.

The strip 4 is guided to the crimping zone over a strip guide plate 42 which has a rib 44 on its underside that is received in a channel 46 in the base plate 16. In addition, a cover 48 is provided which is fastened to the strip guide plate and which extends over the portion of the strip which is adjacent to the crimping zone of the applicator.

Figure 2:
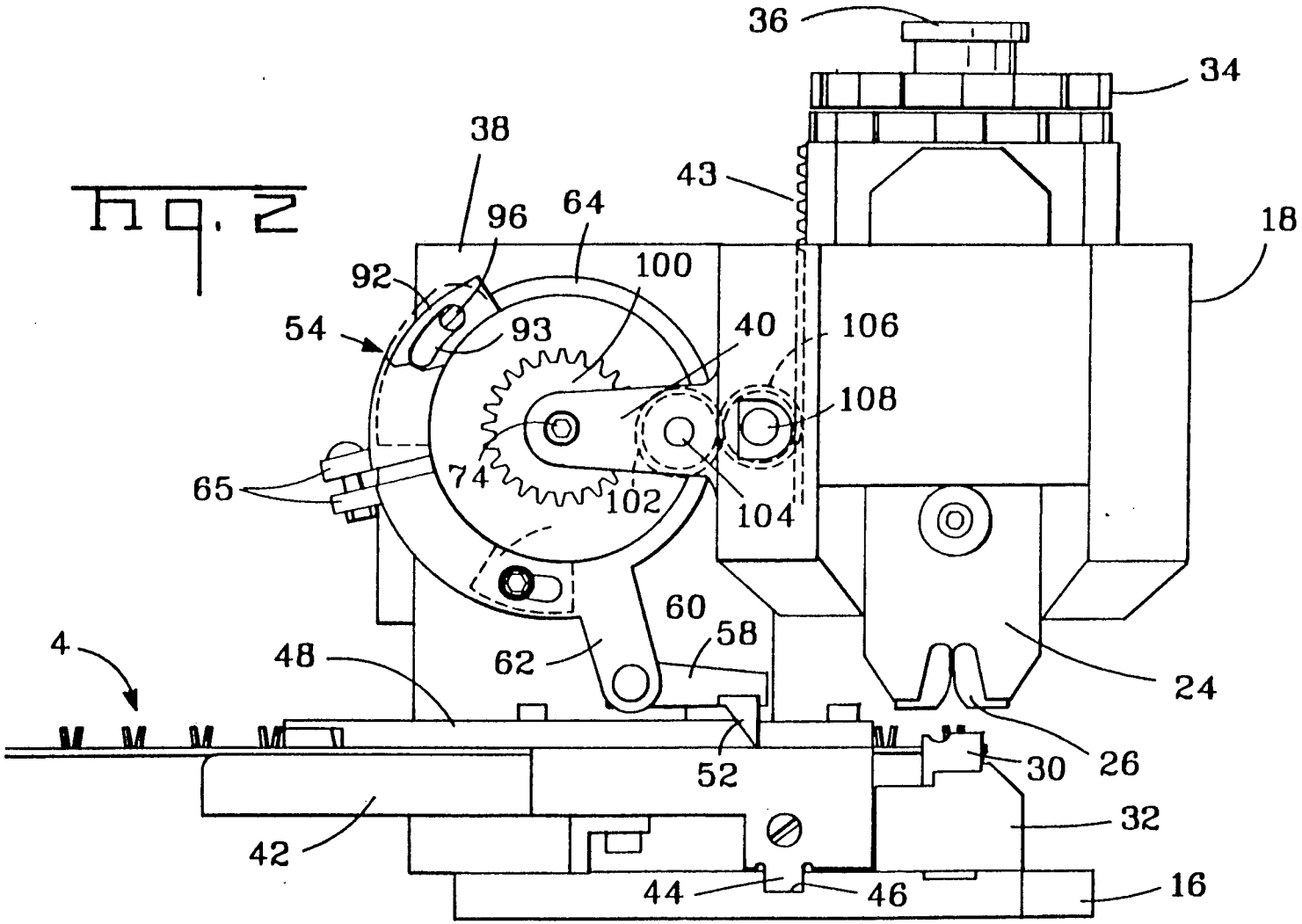
FIG. 2 is a frontal view of the applicator of FIG. 1.

The strip feeding mechanism generally indicated at 54 comprises a feed pawl or feed finger 52 which is on the end of an arm 56 that extends from a block 58 above the upper surface of the cover plate 48. The block 58 is pivotally mounted on a pin 60 which is between the ears 62 of a collar 64. A spring is provided for the block 58 which biases the block and the feed finger in a clockwise direction, as viewed in FIGS. 1 and 2, but which permits the finger to move upwardly when it is retracted from the position shown in the drawing.

Figure 3:
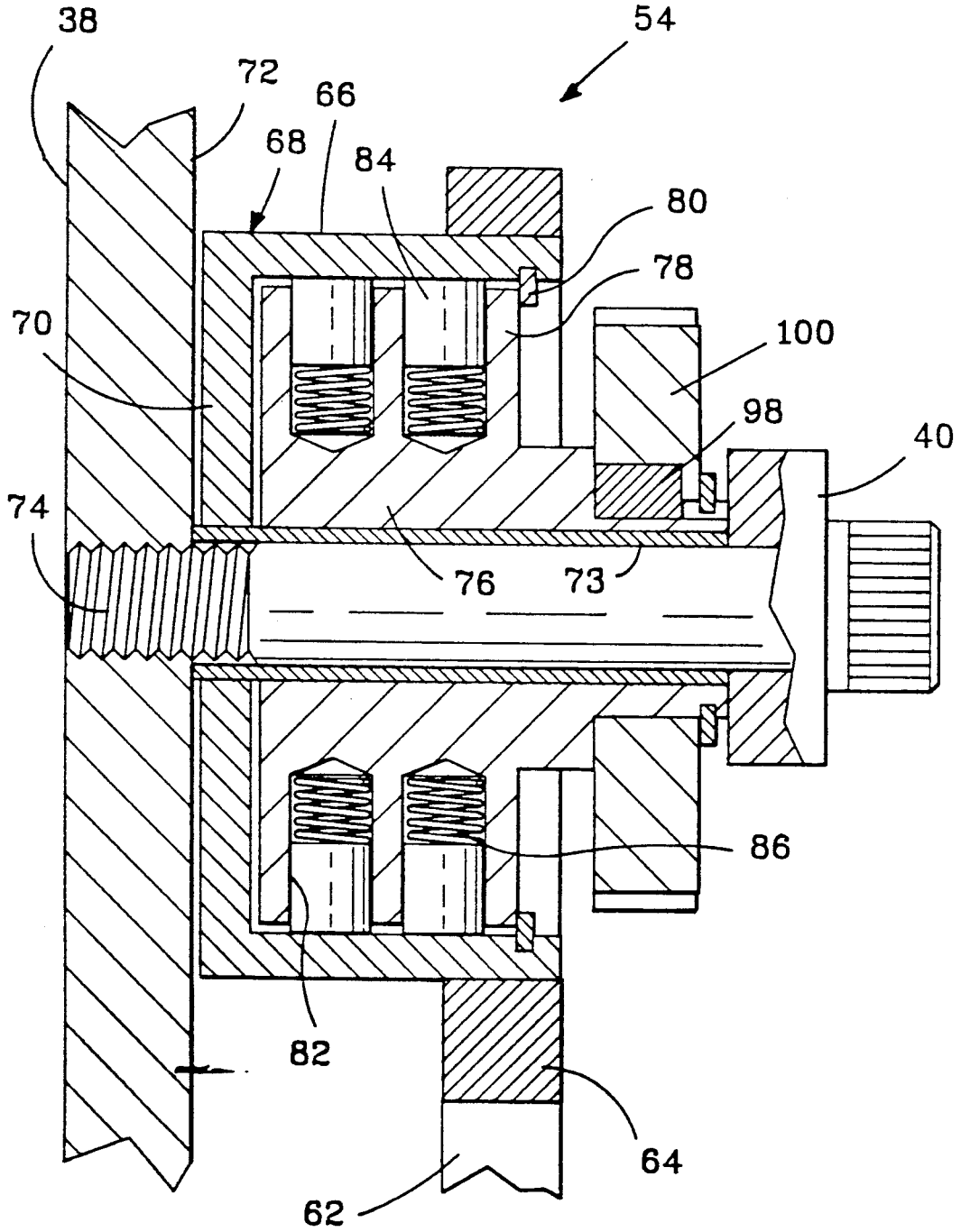
FIG. 3 is a sectional view looking in the direction of the arrows 3—3 of FIG. 1.

The collar 64 is clamped by means of clamping ears 65 and a fastener to the cylindrical external surface 66 of a feed pawl carrier 68. This feed pawl carrier comprises a hollow cylinder open on its right-hand side as viewed in FIG. 3 and which has an inner wall 70 on its left-hand side. The wall 70 is adjacent to the surface 72 of the arm 38 of the frame and is supported for free rotation on a bearing 73 which is on a fixed shaft 74. Shaft 74 is supported in the arm 38 and in the associated ear 40 on the frame.

An oscillatory shaft 76 is also supported for free rotation on the bearing 73 and has an enlarged portion 78 which is within the hollow interior of the feed pawl carrier 68. The enlarged portion is retained in the position shown in FIG. 3 by a snap ring 80 which is received in a circumferential recess in the feed pawl carrier and which extends past the periphery of the enlarged portion 78 of the shaft 76.

The enlarged portion 78 of shaft 76 has a plurality of radially extending recesses 82 in its surface. Each recess contains a spring 86 and a bearing shoe 84 which is resiliently biased against the interior surface of the pawl carrier by its associated spring. The shoes bear against the surface of the pawl carrier with a force which is sufficient to cause the pawl carrier to move with the shaft 76 unless a predetermined torque is exceeded, in which case the shoes will slide over the interior surface of the pawl carrier and the pawl carrier 68 will be stationary while the shaft 76 continues to rotate.

The amplitude of oscillation of the carrier 66 is determined by a fixed stop 88 and two movable stops 92. The fixed stop is secured to the arm 38 by a mounting portion 90. This stop extends laterally past the movable stops 92 which are secured by fasteners 96 to an enlarged portion of the collar 64. These movable stops are adjustably secured to the collar by the provision of arcuate slots 93 through which the fasteners 96 extend. FIG. 1 shows the positions of the parts when the feed finger is at the limit of its forward or feeding stroke. In this view, the stop 92, which limits the feeding stroke of the feed pawl, is against the fixed stop 88 and the pawl carrier 66 cannot move in a counter-clockwise direction from the position shown. The other movable stop similarly limits the retraction stroke of the feed pawl.

The oscillatory shaft 76 has a gear wheel 100 thereon to which it is keyed as shown at 98. The gear 100 is in mesh with an intermediate gear 102 which is supported for free rotation on a pin 104 that is supported in the associated ear 40 on the frame. Gear 102, in turn, is in mesh with a pinion gear 106 that is supported on a pin which is supported in the frame and on a pin 108. The pinion gear, in turn, is in mesh with the rack 43 which is secured in an axial slot in the ram 22.

FIG. 4 shows the directions of rotation of the gears when the ram is moved downwardly from the position of FIG. 1. During such downward movement, the gear 100 will be rotated in a clockwise direction and the feed finger 52 will be retracted from the position shown in FIG. 1. During the subsequent, or following, upward stroke of the ram 22, the feed finger will be moved back to the position of FIG. 1 thereby feeding the leading terminal of the strip into the crimping zone.

FIG. 5 shows an alternative gear train in which the strip is fed during the downward stroke of the ram 22 and is retracted during the upward stroke. In this embodiment, the gear 110 on the oscillatory shaft 76 is directly in mesh with the pinion 112 which, in turn, is in mesh with the rack 43.

As explained in the above-identified application Ser. No. 07/722,635, now U.S. Pat. No. 5,127,255, the feeding mechanism 54 can be mounted on the applicator frame as shown in FIG. 1 if the applicator is intended for terminals in ladder strip form. The same feeding mechanism can be mounted against the arm 38' and between the surface of arm 38' and the ear 40' if the applicator is intended for terminal strip of the in-line type.

It will be apparent from the foregoing that a strip feeding mechanism, in accordance with the invention, is extremely simple and can be used under a wide variety of circumstances, as regards types of terminal strips (whether in-line or ladder strip) and as regards the pitch of the terminals, the length of the feed stroke required, and other variable factors.

I claim:

1. A terminal applicator comprising a frame, a reciprocable ram in the frame, a crimping zone, and a feed pawl for feeding terminal strip towards the crimping zone, the applicator being characterized in that:

the feed pawl is pivotally mounted on an oscillatory pawl carrier which oscillates about an axis so that oscillation of the pawl carrier results in reciprocation of the feed pawl, an oscillatory shaft is provided which is oscillatable about the axis, the shaft being coupled to the ram by gear and rack means whereby reciprocation of the ram results in oscillation of the shaft, the shaft and the feed pawl carrier are coupled to each other by a torque responsive coupling which permits overtravel of the shaft relative to the pawl carrier if a predetermined torque is exceeded and which causes the pawl carrier to oscillate with the shaft when the predetermined torque is not exceeded, and stop means are provided for limiting the amplitude of oscillation of the pawl carrier and thereby limiting the stroke of the feed pawl.

2. A terminal applicator as set forth in claim 1 characterized in that the stop means comprises a fixed stop on the frame and two movable stops on the pawl carrier, one of the movable stops limiting movement of the pawl towards the crimping zone, the other movable stop limiting movement of the pawl away from the crimping zone.

3. A terminal applicator as set forth in claim 2 characterized in that the movable stops are adjustably mounted on the pawl carrier thereby to permit adjustment of the stroke of the feed pawl.

4. A terminal applicator as set forth in claim 1 characterized in that the pawl carrier has an internal recess which surrounds the common axis, the oscillatory shaft extending into the recess and the torque responsive coupling being within the recess.

5. A terminal applicator as set forth in claim 4 characterized in that the pawl carrier has an external surface which surrounds the common axis, the movable stops being adjustably mounted on the external surface.

6. A terminal applicator as set forth in claim 5 characterized in that a feed pawl mounting block is provided on the external surface, the feed pawl being on the feed pawl mounting block.

7. A terminal applicator as set forth in claim 6 characterized in that the stop means comprises a fixed stop on the frame and two movable stops on the pawl carrier, one of the movable stops limiting movement of the pawl towards the crimping zone, the other movable stop limiting movement of the pawl away from the crimping zone, the stops being adjustably mounted on the pawl carrier thereby to permit adjustment of the stroke of the feed pawl.

8. A terminal applicator as set forth in claim 1 characterized in that the pawl carrier is a hollow cylindrical member having an end wall at one end thereof, the end wall being supported for free rotation on a fixed shaft, the axis being the axis of the fixed shaft, the fixed shaft being supported by the frame.

9. A terminal applicator as set forth in claim 8 characterized in that the oscillatory shaft is supported for oscillation on the fixed shaft, the oscillatory shaft extending into the hollow interior of the pawl carrier, the torque responsive coupling being within the hollow interior of the pawl carrier.

10. A terminal applicator as set forth in claim 9 characterized in that the frame has an integral ear thereon, one end of the fixed shaft being supported by the ear, the other end of the fixed shaft being supported by other portions of the frame which are spaced from the ear, the end wall of the pawl carrier being proximate to the other portions of the frame.

11. A terminal applicator as set forth in claim 10 characterized in that the gear and rack means comprises a gear on the oscillatory shaft and a rack on the reciprocable ram.

12. A terminal applicator as set forth in claim 10 characterized in that the gear and rack means comprises a rack on the reciprocable ram, a gear on the oscillatory shaft, and a pinion gear, the pinion gear being in mesh with the rack.

13. A terminal applicator as set forth in claim 11 characterized in that an additional gear is provided between the pinion gear and the gear on the oscillatory shaft.

14. A terminal applicator comprising a frame, a reciprocable ram in the frame, a crimping zone, and a feed pawl for feeding terminal strip along a strip feed path which extends towards the crimping zone, the applicator being characterized in that:

the frame has a fixed shaft thereon which is spaced from, and extends transversely of, the feed path, the fixed shaft having an axis, a hollow cylindrical pawl carrier is supported for rotation on the fixed shaft, an oscillatory shaft is supported on the fixed shaft for oscillation about the axis, the oscillatory shaft is coupled to the ram by gear and rack means so that the oscillatory shaft is oscillated in synchronism with reciprocation of the ram, the oscillatory shaft and the pawl carrier are coupled by a torque responsive coupling which permits overtravel of the oscillatory shaft if a predetermined torque is exceeded and which causes the pawl carrier to oscillate with the oscillatory shaft when the predetermined torque is not exceeded, and the feed pawl is carried by the pawl carrier whereby, during reciprocation of the ram, the oscillatory shaft and the pawl carrier are oscillated and the feed pawl is reciprocated thereby to feed the terminal strip.

15. A terminal applicator as set forth in claim 14 characterized in that the pawl carrier has an end wall by means of which it is supported on the fixed shaft, the oscillatory shaft extends into the hollow interior of the pawl carrier and to the end wall, the torque responsive coupling is within the pawl carrier, and a fixed stop and two movable stops are provided on the frame and pawl carrier respectively for limiting the stroke of the pawl towards and away from the crimping zone.

16. A terminal applicator as set forth in claim 15 characterized in that the gear and rack means comprises a gear on the oscillatory shaft and a rack on the ram.

17. A terminal applicator as set forth in claim 16 characterized in that the gear and rack means comprises at least one additional gear which is between the rack and the gear on the oscillatory shaft.

* * * * *